US005810162A

United States Patent [19]

Au et al.

[11] Patent Number: 5,810,162

[45] Date of Patent: Sep. 22, 1998

[54] JEWELRY BOX

[75] Inventors: Ka Fai Kinsen Au; Ho Ching Au, both of Hong Kong, Hong Kong

[73] Assignee: Nationalpak Limited

[21] Appl. No.: 879,503

[22] Filed: Jun. 20, 1997

[51] Int. Cl.[6] ..... A45C 11/16

[52] U.S. Cl. ..... 206/6.1; 206/566; 16/334; 220/335

[58] Field of Search ..... 206/6.1, 566, 457; 220/335; 16/331, 334

[56] References Cited

U.S. PATENT DOCUMENTS

| | | | |
|---|---|---|---|
| 2,180,885 | 11/1939 | Sundee | 206/564 |
| 2,250,433 | 7/1941 | Dean | 206/566 |
| 4,005,775 | 2/1977 | Crosslen | 206/6.1 |
| 5,383,552 | 1/1995 | Dikowitz | 206/6.1 |
| 5,452,501 | 9/1995 | Kramer et al. | 16/334 |

*Primary Examiner*—Paul T. Sewell
*Assistant Examiner*—Luan K. Bui
*Attorney, Agent, or Firm*—David & Raymond; Raymond Y. Chan

[57] ABSTRACT

A jewelry box includes a case body, at least a cover lip and at least a hinge means for connecting the cover lip to the case body. The case body has an interior cavity defined therein and at least a side opening. The cover lip has a size adapted to cover the side opening of the case body. The hinge means comprises a first piece and a second piece pivotally connected with the first piece. The first piece is affixed to a bottom edge portion of the cover lip and the second piece is affixed to the bottom wall of the case body. The jewelry box may further includes a holder means disposed therein for holding a jewelry or a watch inside the inner cavity. Whereby, the cover lip which is normally covered with the side opening of the case body can be pulled and turned sidewardly from the case body to uncover the case body until both the case body and the cover lip evenly standing on a supporting surface, such as a table surface, to keep the jewelry box's balance, wherein the weights of the case body and the cover lip are respectively and stably supported at their contact points with the supporting surface while displaying the jewelry received in the jewelry box.

18 Claims, 6 Drawing Sheets

JEWELRY BOX

FIELD OF THE INVENTION

The present invention relates to jewelry box, and more particularly to a jewelry box with at least a side-way opening cover lid which not only provides a more firm and stable standing capability during jewelry display, but also is capable of receiving more than one jewelry holders for providing a more glamorous jewelry display.

BACKGROUND OF THE PRESENT INVENTION

In today's society, there are countless amount of jewelry out in the market and the ownership of jewelry has become a part of everyone's dream. Jewelry plays a big role in customs and images such that, in traditional weddings, the rings play an important role in the ceremony.

Jewelry shops sell and display numerous types of jewelry made by different jewelry makers. Most of the time, jewelry is sold and displayed in a jewelry box. Especially the rings, they are the most common type of jewelry being sold out in the market today and they are being given away as a gift in a common jewelry box with a top opening lid.

The conventional jewelry box, as shown in FIG. 1, comprises a case base A1 having a holding pad A11 received therein and a top lip A2 hingedly connected on top of the case base A1 to form a box configuration. A single ring B1 or a set of earrings is held in position on the holding pad A11 inside the case base A1 for storage purpose and the top lip A2 can be lifted up to a vertical open position as shown in FIG. 1 for display purpose. However, when the top lip A2 is lifted up vertically, the weight of the top lip A2 shifts aside with respect to the center of gravity of the case base A1. In other words, the lifted up position of the top lid A2 generates an unbalance weight position, so that the opened jewelry box has a trend to tip over and can barely have a stable standing during display.

Moreover, the conventional jewelry box can only enable the consumers to view and admire the jewelry disposed therein from a front position since the lifted up top lip A2 blocks the sight behind the top lip A2. Most jewelry, however, should be displayed for viewing in all direction in order to demonstrate its special design and appeal. In other words, the conventional jewelry box is not a proper and appropriate display tool. Besides, each conventional jewelry box is merely suitable for receiving a single piece of jewelry. None of the prior art provides a kind of jewelry box that can display a pair of wedding rings simultaneously and symmetrically.

The prior art not only is inconvenient, but also has an outer appearance getting really boring and outdated. A jewelry box should bring a more glamorous appeal especially during special moments in our lives which we would remember for life. Also it would be great if a pair of rings can be given as a gift in the same jewelry box at a wedding as a special gift to someone we love to surprise them and show them how much we care.

SUMMARY OF THE PRESENT INVENTION

The main object of the present invention is to provide a jewelry box comprising a case body and at least a side-way opening cover lid adapted to open sidewardly until both the case body and the cover lip evenly standing on a supporting surface, such as a table surface, to keep the jewelry box's balance, wherein the weights of the case body and the cover lip are respectively and stably supported at their contact points with the supporting surface while displaying the jewelry stored in the jewelry box.

Another object of the present invention is to provide a jewelry box which enables the jewelry received therein to be viewed and admired in all direction while it is opened for display purpose.

Another object of the present invention is to provide a jewelry box in which the cover lip thereof is also adapted for holding a jewelry for storage and display purposes.

Another object of the present invention is to provide a jewelry box which may store more than one of jewelry in a single jewelry box.

Another object of the present invention is to provide a jewelry box which comprises two cover lips hingedly connected to two sides of the case body respectively, so that the jewelry box can respectively receive two jewelry in both sides of the case body or both the cover lips. Both cover lips can be opened sidewardly and stood on the supporting surface for further enhancing the stability of the jewelry box while displaying the two jewelry simultaneously and symmetrically.

Accordingly, the present invention provides a jewelry box which comprises a case body, at least a cover lip and at least a hinge means for connecting the cover lip to the case body. The case body has an interior cavity defined therein and at least a side opening defined by a front wall, a back wall, a top wall, and a bottom wall of the case body. The cover lip has a size adapted to cover the side opening of the case body. The hinge means comprises a first piece and a second piece pivotally connected with the first piece. The first piece is affixed to a bottom edge portion of the cover lip and the second piece is affixed to the bottom wall of the case body.

The jewelry box may further comprises a holder means disposed therein for holding a jewelry or a watch inside the inner cavity. Whereby, the cover lip which is normally covered with the side opening of the case body can be pulled and turned sidewardly from the case body to uncover the case body until both the case body and the cover lip evenly standing on a supporting surface, such as a table surface, to keep the jewelry box's balance, wherein the weights of the case body and the cover lip are respectively and stably supported at their contact points with the supporting surface while displaying the jewelry received in the jewelry box.

The jewelry box further comprises a positioning means for firmly holding the cover lip in a close position to cover case body as well as firmly holding the cover lip to remain in an open position when it is pulled sidewardly apart from side opening to open the case body.

DETAILED DESCRIPTION OF THE PREFERRED EMBODIMENT

Figure 1:
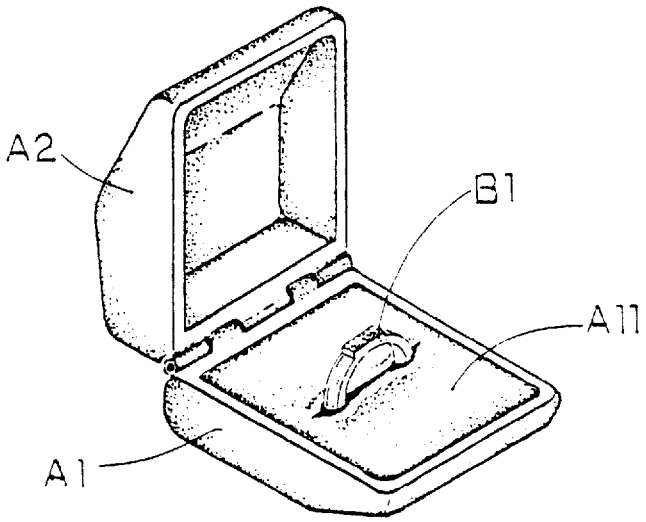
FIG.1 PRIOR ART
FIG. 1 is a perspective view of a conventional jewelry box.

Please referring to FIGS. 2 to 6 of the drawings, in which a jewelry box 5 according to a first preferred embodiment of the present invention is illustrated. The jewelry box 5 comprises a case body 10, a first and a second side-way opened cover lip 11A, 11B, and two hinge means 20A, 20B for connecting the two cover lips 11A, 11B to the two convex sides of the case body 10 respectively. The case body 10 has an interior cavity 40 defined therein and two side openings 12A, 12B respectively provided at the two convex sides of the case body 10, wherein the two side openings 12A, 12B are defined by a front wall 101, a back wall 102, a top wall 103, and a V-shape bottom wall 104 of the case body 10. The two cover lips 11A, 11B respectively have a size adapted to cover the two side openings 11A and 11B of the case body 10.

Figure 3:
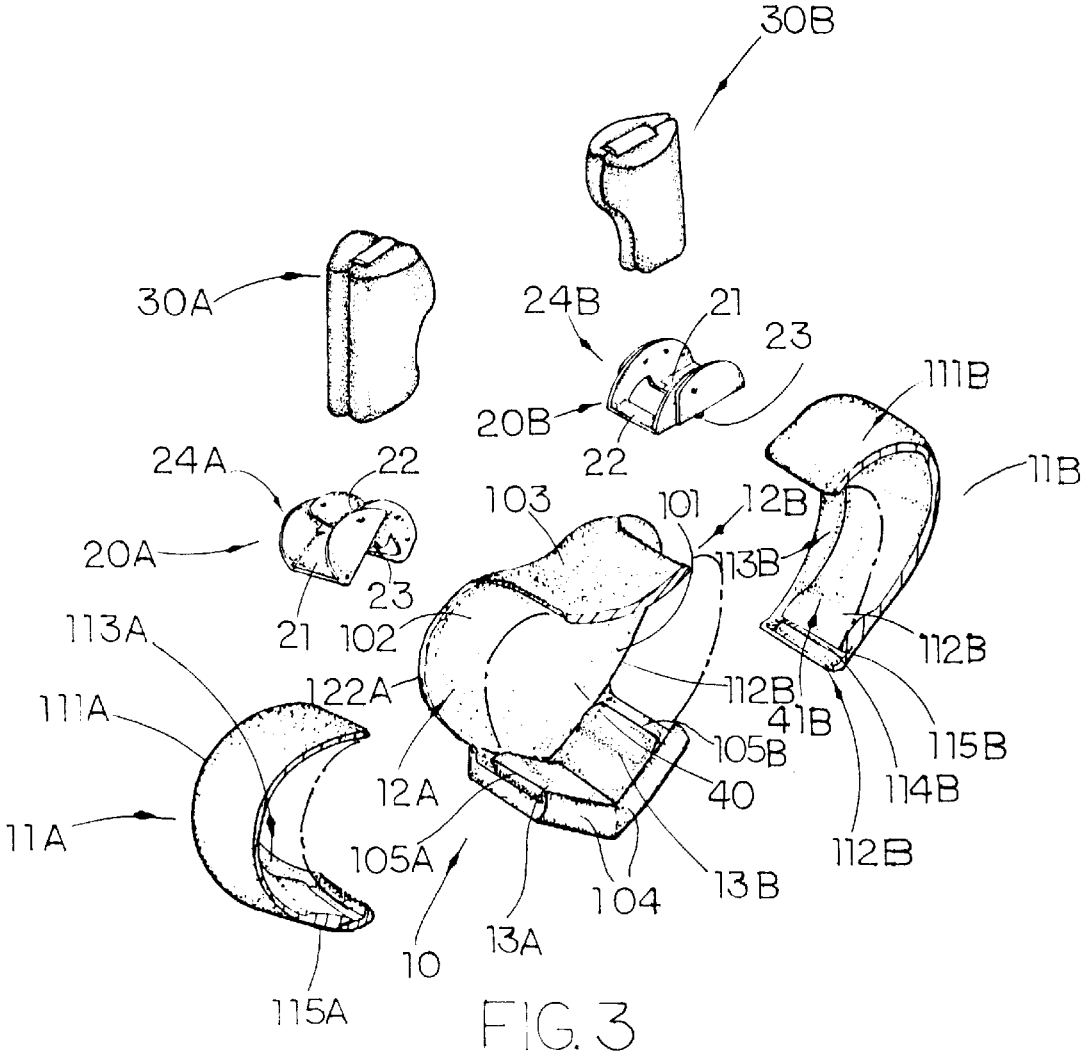
FIG. 3 is a sectional exploded perspective view of the jewelry box of the above first preferred embodiment according to the present invention.

As shown in FIG. 3, the jewelry box 5 further comprises two holder means 30A, 30B adapted to be received inside the interior cavity 40 in side by side manner for holding at least two jewelry at the two side openings 12A, 12B respectively. Whereby, the two cover lips 11A, 11B which are normally and respectively covered the two side openings 12A, 12B of the case body 10 can be respectively and independently pulled and turned sidewardly about the two hinge means 20A, 20B from the case body 10 to uncover the two side openings 12A, 12B of case body 10 until both the case body 10 and the two cover lips 11A, 11B evenly standing on a supporting surface, such as a table surface, to keep the jewelry box's 5 balance, wherein the weights of the case body 10 and the two cover lips 11A, 11B are respectively and stably supported at their contact points with the supporting surface while displaying the jewelry received in the jewelry box.

Figure 2:
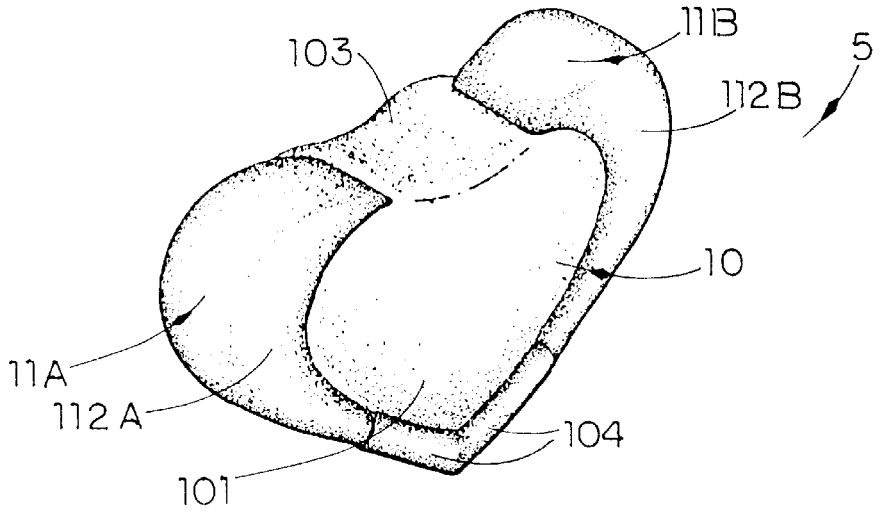
FIG. 2 is perspective view of a jewelry box according to a first preferred embodiment of the present invention.

In accordance with the first preferred embodiment, as shown in FIG. 2, the jewelry box 5 is embodied as a cartoon heart shape box. As shown in FIG. 3, the front wall 101 and the back wall 102 have an identical cartoon heart shape. The top wall 103 is transversally connected between a central top portion of the front wall 101 and a central top portion of the back wall 102. The bottom wall 104 is perpendicularly and integrally extended from a central bottom edge portion of the front wall 101 to a central bottom edge of the back wall 102 so as to support the front wall 101 and the back wall 102 parallelly and define the interior cavity 40 between the front and back walls 101, 102. The front wall 101 and the back wall 102 each has two symmetrical convex side edges 122A, 122B between the top wall 103 and the bottom wall 104 so as to define the left side opening 12A between the left convex side edges 122A of the front and back walls 101, 102 and to define the right side opening 12B between the right convex side edges 122B of the front and back walls 101, 102.

Referring to FIGS. 2 and 3, the first cover lid 11A and the second cover lid 11B are identical in shape and structure that each comprises a C-shaped side wall 111A, 111B which two parallel edges integrally connecting with a front panel 112A, 112B and a back panel 113A, 113B respectively to form a moon shape lip body having a receiving chamber 41A, 41B defined therein.

Each of the hinge means 20A, 20B comprises a first piece 21 and a second piece 22 pivotally connected with the first piece 21. The first pieces 21 of the two hinge means 20A, 20B are respectively affixed by gluing (or by screwing) to a bottom edge portion 114A of the first cover lip 11A and a bottom edge portion 114B of the cover lip 11B; the second pieces of the two hinge means 20A, 20B are respectively affixed by gluing (or by screwing) to two side edge portions 105A, 105B of the bottom wall 104 of the case body 10, so that the first and second cover lips 11A, 11B are hingedly and pivotally connected with the case body.

In order to render the two cover lips be operated between a close position to cover the side openings 12A, 12B of the case body 10 and an open position to uncover the side openings 12A, 12B of the case body 10, the jewelry box 5 further comprises two positioning means 24A, 24B for respectively and firmly holding the two cover lips 11A, 11B in the close position to cover case body as well as firmly holding the two cover lip 11A, 11B to remain in the open position when it is pulled sidewardly apart from side openings 12A, 12B to open the case body 10.

Figure 4:
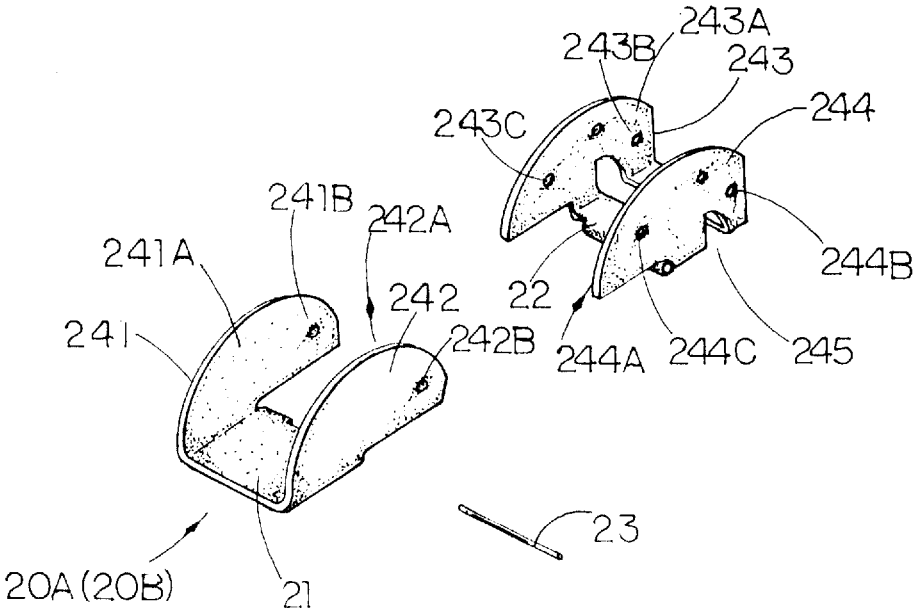
FIG. 4 is an exploded perspective view of a butterfly joint of the jewelry box according to the above first preferred embodiment of the present invention.
Figure 5:
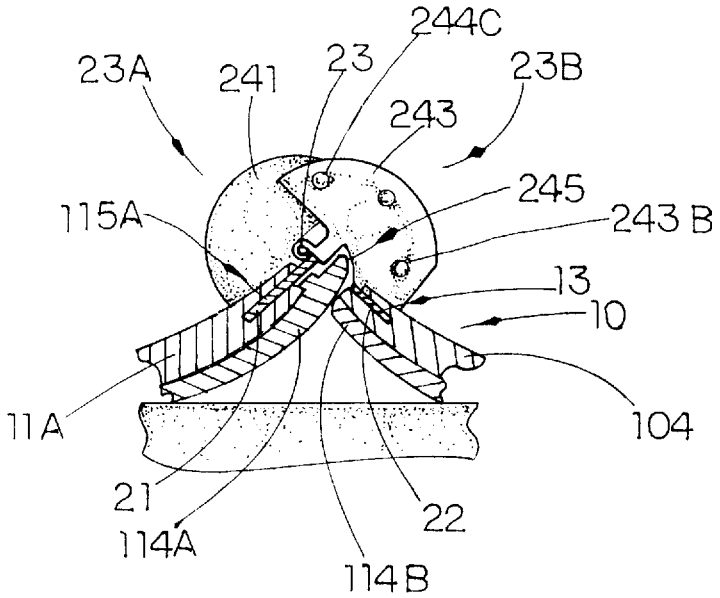
FIG. 5 is a partially sectional side view of the jewelry box according to the above first preferred embodiment of the present invention, showing how the butterfly joint is operated and incorporated with the case body and the cover lip of the jewelry box.

According to the present embodiment, the two positioning means 23A, 23B are respectively provided with the two hinge means 20A, 20B. As shown in FIGS. 3, 4 and 5, each of the hinge means 20A, 20B comprises a pivot pin 23 for pivotally connecting the first piece 21 and the second piece 22 together to provide hinge effect. The two first pieces 21 of the two hinge means 20A, 20B are respectively inserted and glued into two receiving grooves 115A, 115B formed at the two bottom edge portions 114A, 114B of the two first and second cover lips 11A, 11B respectively for affixing the two first pieces 21 firmly in position with the two cover lips 11A, 11B. On the other hand, the two second pieces 22 of the two hinge means 20A, 20B are respectively inserted and glued into two receiving gaps 13A, 13B formed at two side edge portions 105A, 105B of the bottom wall 104 respectively for affixing the two second pieces 22 firmly in position with the bottom wall 104 of the case body 10.

Each of the two positioning means 24A, 24B comprises two symmetrical semicircular first wings 241, 242 and two symmetrical semi-circular second wings 243, 244. The two first wings 241, 242 are respectively extended from two side edges of the first piece 21 upwardly and perpendicularly in semi-circular manner toward the top surface of the second piece 22, as shown in FIG. 3. The two second wings 243, 244 are also respectively extended from two side edges of the second piece 22 upwardly and perpendicularly in semi-circular manner toward the top surface of the first piece 21. However, the distance between the two first wings 241, 242 is slightly wider than the distance between the two second wings 243, 244, so that the two parallel first wings 241, 242 and the two parallel second wings 243, 244 can be proximately overlapped when the first and second pieces 21, 22 are aligned in linearly horizontal position.

On the inner surfaces 241A, 242A of the two first wings 241, 242 each forms a circular protrusion 241B, 242B near a far end thereof. On the outer surfaces 243A, 244A of the two second wings 243, 244 each forms at least two circular indentions 243B, 243C and 244B, 244C near two ends thereof. Therefore, when the first and second pieces 21, 22 are aligned in linearly horizontal position, i.e. the close position, the two protrusions 241B, 242B of the two first wings 241, 242 are appropriately engaged with the two indentions 243B, 244B of the two second wings 243, 244 respectively, so that the first piece 21 and the second piece 22 of the hinge means 20A, 20B are thus locked in this linearly aligning position so as to ensure the close position of the respective cover lip 11A, 11B, as shown in FIG. 2, to fittedly cover the corresponding side opening 12A, 12B of the case body 10.

Figure 6:
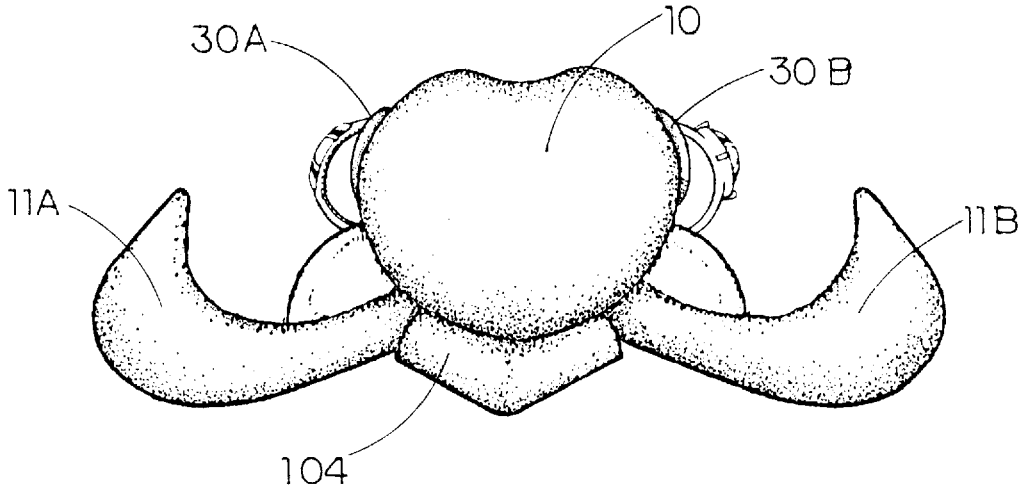
FIG. 6 is an end view of the jewelry box according to the above first preferred embodiment of the present invention, showing the jewelry box holding a pair of couple rings in opened display condition.

As shown in FIGS. 4 and 5, each of the second pieces 22 of the two hinge means 20A, 20B further provides a slot 245 which is extended to the two second wings 243, 244 upwardly. When a pulling force is applied to any one of the first and second cover lips 11A, 11B to overcome the engagement between the two protrusions 241B, 242B on the two first wings 241, 242 and the two indentions 243B, 244B on the two second wings 243, 244, the respective cover lip 11A, 11B is pulled and turned, about the pivot pin 23, sidewardly apart from the case body 10 to the open position (as shown in FIG. 6) for uncovering the corresponding side opening 12A, 12B until the two protrusions 241B, 242B on the two first wings 241, 242 connected to the respective cover lip 11A, 11B are appropriately engaged with the two indentions 243C, 244C of the two second wings 243, 244 connected with the case body 10, so that the first and second pieces 21, 22 of the hinge means 20A, 20B are locked in a relatively V-shaped condition, as shown in FIG. 5, to maintain the open position of the respective cover lip 11A, 11B. At such open position, the bottom edge portion 114B of the respective cover lip 11A, 11B is fittedly inserted into the slot 245 provided on the corresponding second piece 22 of the hinge means 24A, 24B, so that the first and second cover lips 11A, 11B are capable of being opened sidewardly at a wider angle from the case body 10 until their outer surfaces are in contact with the supporting surface, as shown in FIGS. 5 and 6, to ensure a balance and stable standing ability for the jewelry box 5 when displaying its content. Accordingly, as shown in FIG. 6, the jewelry's held in position by the two holder means 30A, 30B can be viewed in all directions.

Alternatively, the two holder means 30A, 30B can also be disposed within the two receiving chambers 41A, 42B of the two cover lips 11A, 11B respectively to hold the jewelry's in position. When the two cover lips 11A, 11B are respectively turned upwardly to the close position, the jewelry's will then be stored within the interior cavity 40 of the case body 10.

Figure 7:
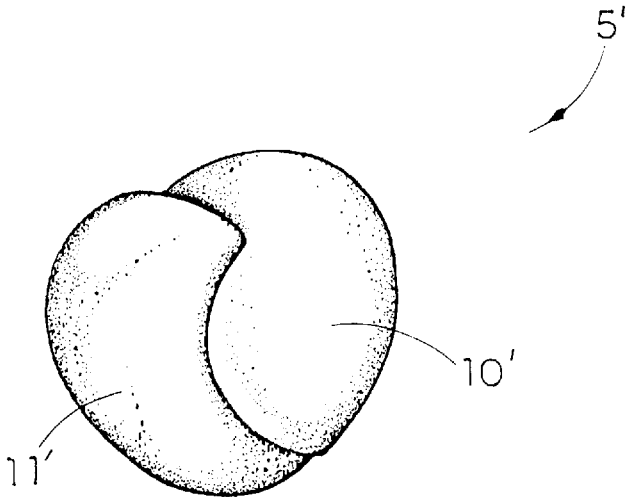
FIG. 7 is a perspective view of a jewelry box according to a second preferred embodiment of the present invention.
Figure 8:
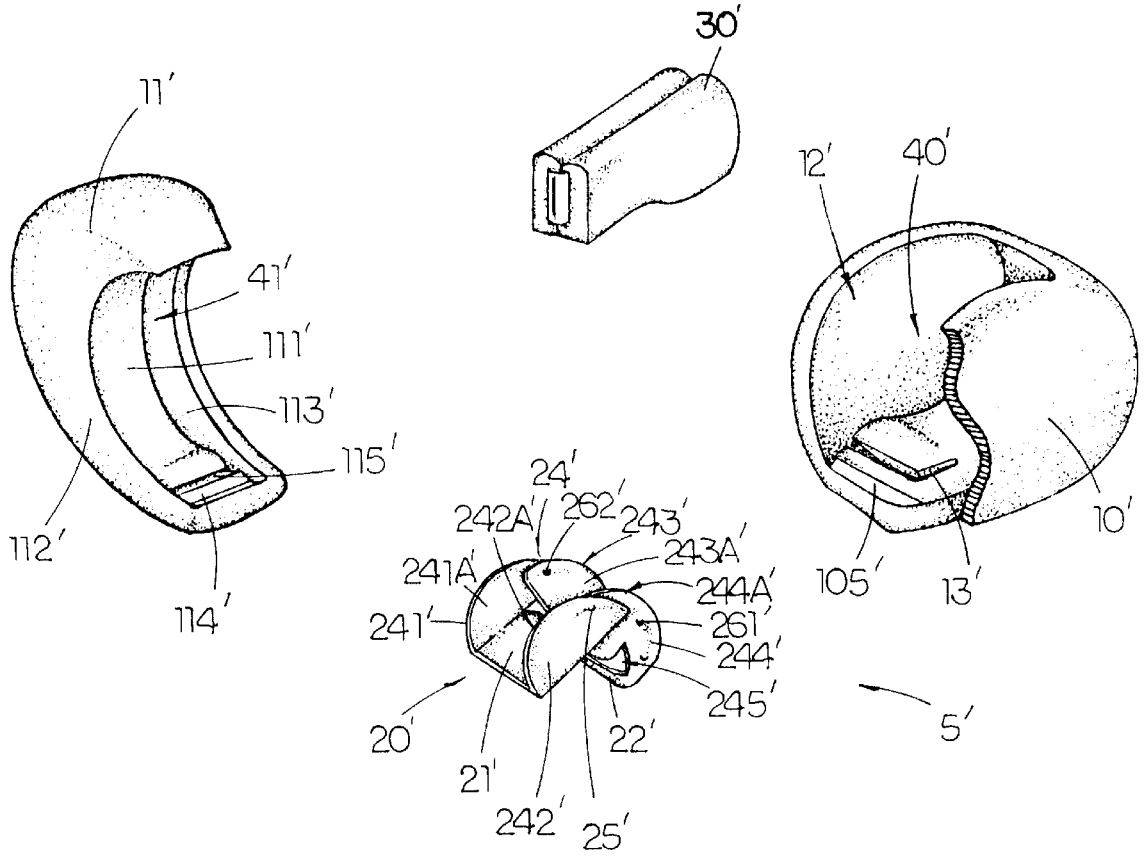
FIG. 8 is a partial sectional exploded perspective view of the jewelry box according to the above second preferred embodiment which is an alternative mode of the present invention.
Figure 9:
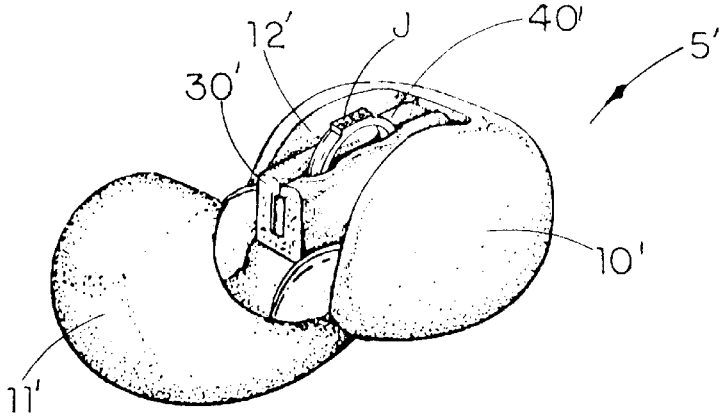
FIG. 9 is a perspective view of a jewelry box according to the above second preferred embodiment of the present invention, showing the jewelry box holding a ring in opened display condition.

Referring to FIGS. 7 to 9, a second preferred embodiment which is an alternative mode of the above first preferred embodiment is shown to illustrate that the jewelry box can also provide merely one cover lip.

The jewelry box 5' according to the second embodiment also comprises a case body 10' having an interior cavity 40' defined therein to receive a holder means 30' for holding a jewelry J in position. The case body 10' further has a convex side opening 12' communicating with the interior cavity 40'. The jewelry box 5' merely comprises a cover lip 11' adapted for covering the side opening 11' of the case body 10' and a hinge means 20' for pivotally connecting the cover lip 11' to the case body 10'.

According to this second embodiment, the case body 10' and the cover lip 11' combines to form an imitating heart shaped body. The cover lip 11' also comprises a C-shaped side wall 111' which two parallel edges integrally connecting with a front panel 112' and a back panel 113' respectively to form a moon shape lip body having a receiving chamber 41' defined therein, as shown in FIG. 8.

The hinge means 20' has an identical configuration with the hinge means 20A, 20B disclosed in the above first preferred embodiment, which also comprises a first piece 21' and a second piece 22' pivotally connected with the first piece 21'. The connection manner of the hinge means 20' with the case body 10' and the cover lip 11' according to this second embodiment is identical to the connection of the two hinge means 20A, 20B with the case body 10 and the two cover lips 11A, 11B disclosed in the above first embodiment. That is the first piece 21' is affixed to a bottom edge portion 114' of the cover lip 11' by inserting and gluing the first piece 21' into a receiving groove 115' provided on the bottom edge portion 114' and the second piece 22' is affixed to a side edge portion 105' of the bottom wall 104' of the case body 10' by inserting and gluing the second piece 22' into a receiving gap 13' formed at the side edge portion 105' of the bottom wall 104' of the case body 10'. On the second piece 22, similarly a slot 245' is transversely formed thereon to fittedly receive a tip portion of the bottom edge portion 114' of the cover lip 11' when the cover lip 11' is pulled and turned sidewardly apart from the case body 10' to the open position, so as to enable the cover lip 11' being opened more wider until both the outer surfaces of the cover lip 11' and case body 10' are in contact with the supporting surface to ensure a balance and stable standing of the jewelry box 5', wherein the weight of the case body 10' and the cover lip 11' can be evenly and stably supported by the supporting surface.

Similarly, the jewelry box 5' of the second embodiment also comprises a positioning means 24' for firmly holding the cover lip 11' in a close position to cover case body 10' as well as firmly holding the cover lip 11' to remain in an open position when it is pulled sidewardly apart from side opening 12' to open the case body 10'. The positioning means 24' is identical to that of the first preferred embodiment, which comprises two symmetrical semi-circular first wings 241' 242' and two symmetrical semi-circular second wings 243' 244'. The two first wings 241', 242' are respectively extended from two side edges of the first piece 21' upwardly and perpendicularly in semi-circular manner toward the top surface of the second piece 22'. The two second wings 243', 244' are also respectively extended from two side edges of the second piece 22' upwardly and perpendicularly in semi-circular manner toward the top surface of the first piece 21'. However, the distance between the two first wings 241', 242' is slightly wider than the distance between the two second wings 243', 244', so that the two parallel first wings 241', 242' and the two parallel second wings 243', 244' can be proximately overlapped when the first and second pieces 21', 22' are aligned in linearly horizontal position.

On the inner surfaces 241A', 242A' of the two first wings 241', 242' each forms a circular protrusion 25' near a far end thereof. On the outer surfaces 243A', 244A' of the two second wings 243', 244' each forms at least two circular indentions 261', 262' near two ends thereof. Therefore, when the first and second pieces 21',22' are aligned in linearly horizontal position, i.e. the close position, the two protrusions 25' of the two first wings 241', 242' are appropriately engaged with the two indentions 261' of the two second wings 243', 244' respectively, so that the first piece 21' and the second piece 22' of the hinge means 20' are thus locked in this linearly aligning position so as to ensure the close position of the cover lip 11' to fittedly cover the side opening 12' of the case body 10'.

When a pulling force is applied to the cover lip 11' to overcome the engagement between the two protrusions 25' on the two first wings 241', 242' and the two indentions 262' on the two second wings 243', 244', the cover lip 11' is pulled and turned sidewardly apart from the case body 10' to the open position for uncovering the side opening 12' until the two protrusions 25' on the two first wings 241', 242' connected to the cover lip 11' are appropriately engaged with the two indentions 262' of the two second wings 243', 244' connected with the case body 10', so that the first and second pieces 21', 22' of the hinge means 20' are locked in a relatively V-shaped condition to maintain the open position of the cover lip 11'.

Whereby, the cover lip 11' which is normally covered with the side opening 12' of the case body 10' can be pulled and turned sidewardly from the case body 10' to uncover the case body 10' until both the case body 10' and the cover lip 11' evenly standing on a supporting surface, such as a table surface, to keep the jewelry box's 5' balance, wherein the weights of the case body 10' and the cover lip 11' are respectively and stably supported at their contact points with the supporting surface while displaying the jewelry J received in the jewelry box 5'.

Alternatively, the holder means 30' can also be disposed within the receiving chamber 41' of the cover lips 11' to hold the jewelry J in position. When the cover lip 11' is turned upwardly to the close position, the jewelry J will then be stored within the interior cavity 40' of the case body 10'.

Figure 10:
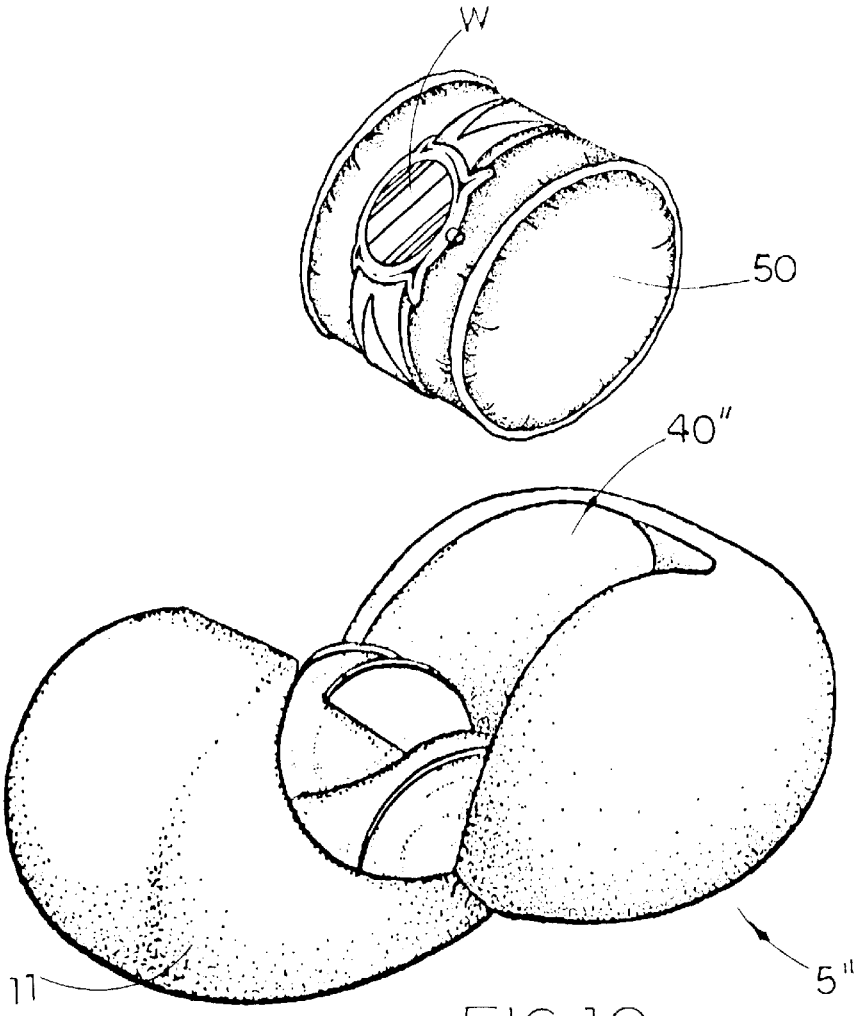
FIG. 10 is a perspective view of the jewelry box having a larger size to receive a watch holder therein for holding a watch according to the above second preferred embodiment of the present invention.

As shown in FIG. 10, an alternative usage of the jewelry box according to the above second preferred embodiment is illustrated, wherein the jewelry box 5" has a larger size and a watch holder 50 for holding a watch W is received inside the inner cavity 40" of the case body 10" instead of the holder means as shown in FIGS. 3 and 8. The inner cavity 40" can also be closed by the cover lip 11". Accordingly, the usage of the present invention should not be limited to any kind of jewelry. In other words, the scope of the patent right pending in this application should be deemed to be protected by the claims reciting in the following pages.

What is claimed is:

1. A jewelry box, comprising:

a case body having an interior cavity defined therein to receive a holder means for holding at least a jewelry in position, said case body further having a side opening communicating with said interior cavity;

a cover lip adapted for covering said side opening of said case body;

a hinge means for pivotally connecting a bottom edge portion of said cover lip to a side edge portion of a bottom wall of said case body, wherein said hinge means comprises a first piece and a second piece pivotally connected with said first piece, an end portion of said first piece being affixed to said bottom edge portion of said cover lip and an end portion of said second piece being affixed to said side edge portion of said case body, wherein on said second piece, a slot is transversely formed thereon to fittedly receive a tip portion of said bottom edge portion of said cover lip when said cover lip is pulled and turned sidewardly apart from said case body to said open position, so as to enable said cover lip being opened wide until both outer surfaces of said cover lip and said case body are in contact with a supporting surface to ensure a balance and stable standing of said jewelry box, wherein weights of said case body and said cover lip are evenly and stably supported by said supporting surface; and a positioning means for firmly holding said cover lip in a close position to cover said side opening of said case body and firmly holding said cover lip to remain in an open position when it is pulled sidewardly apart from said side opening to open said case body.

2. A jewelry box, as recited in claim 1, wherein said end portion of said first piece of said hinge means is inserted and glued into a receiving groove provided on said bottom edge portion and said end portion of said second piece of said hinge means is inserted and glued into a receiving gap formed at said side edge portion of said case body.

3. A jewelry box, as recited in claim 1, wherein said positioning means comprises two symmetrical semi-circular first wings and two symmetrical semi-circular second wings, said two first wings being respectively extended from two side edges of said first piece upwardly and perpendicularly in semi-circular manner toward a top surface of said second piece, said two second wings being also respectively extended from two side edges of said second piece upwardly and perpendicularly in semi-circular manner toward a top surface of said first piece, so that said two first wings and said two second wings are capable of proximately overlapping when said first and second pieces are aligned in linearly horizontal position.

4. A jewelry box, as recited in claim 3, wherein each of said two first wings has an inner surface forming a circular protrusion near a far end thereof, each of said two second wings having an outer surfaces forming at least a first and a second circular indention near two ends thereof, so that when said first and second pieces are aligned in linearly horizontal position, that is said close position, said two protrusions of said two first wings being appropriately engaged with said two first indentions of said two second wings respectively, whereby said first piece and said second piece of said hinge means are thus locked in said linearly aligning position so as to ensure said close position of said cover lip to fittedly cover said side opening of said case body, and that when a pulling force is applied to said cover lip to overcome an engagement between said two protrusions on said two first wings and said two first indentions on said two second wings, said cover lip is pulled and turned sidewardly apart from said case body to said open position for uncovering said side opening until said two protrusions on said two first wings connected to said cover lip are appropriately engaged with said two second indentions of said two second wings connected with said case body, so that said first and second pieces of said hinge means are locked in a relatively V-shaped condition to maintain said open position of said cover lip.

5. A jewelry box, as recited in claim 2, wherein said positioning means comprises two symmetrical semi-circular first wings and two symmetrical semi-circular second wings, said two first wings being respectively extended from two side edges of said first piece upwardly and perpendicularly in semi-circular manner toward a top surface of said second piece, said two second wings being also respectively extended from two side edges of said second piece upwardly and perpendicularly in semi-circular manner toward a top surface of said first piece, so that said two first wings and said two second wings are capable of proximately overlapping when said first and second pieces are aligned in linearly horizontal position.

6. A jewelry box, as recited in claim 5, wherein each of said two first wings has an inner surface forming a circular protrusion near a far end thereof, each of said two second wings having an outer surfaces forming at least a first and a second circular indention near two ends thereof, so that when said first and second pieces are aligned in linearly horizontal position, that is said close position, said two protrusions of said two first wings being appropriately engaged with said two first indentions of said two second wings respectively, whereby said first piece and said second piece of said hinge means are thus locked in said linearly aligning position so as to ensure said close position of said cover lip to fittedly cover said side opening of said case body, and that when a pulling force is applied to said cover lip to overcome an engagement between said two protrusions on said two first wings and said two first indentions on said two second wings, said cover lip is pulled and turned sidewardly apart from said case body to said open position for uncovering said side opening until said two protrusions on said two first wings connected to said cover lip are appropriately engaged with said two second indentions of said two second wings connected with said case body, so that said first and second pieces of said hinge means are locked in a relatively V-shaped condition to maintain said open position of said cover lip.

7. A jewelry box, as recited in claim 5, wherein said case body and said cover lip combines to form an imitating heart shaped body, said side opening of said case body being a convex side opening, said cover lip also comprising a C-shaped side wall which two parallel edges integrally connecting with a front panel and a back panel respectively to form a lip body having a receiving chamber defined therein.

8. A jewelry box, as recited in claim 1, further comprising a second cover lip, a second hinge means and a second positioning means, wherein said case body further has a second side opening at another opposite side thereof for communicating with said interior cavity of said case body, a second holder means being disposed in said interior cavity to hold another jewelry in position through said second side opening said second cover lip being adapted to fittedly cover said second side opening, said hinge means being adapted for pivotally connecting a bottom edge portion of said second cover lip to another opposite side edge portion of said case body, said second positioning means for firmly holding said second cover lip in a close position to cover said second side opening of said case body and firmly holding said second cover lip to remain in an open position when it is pulled sidewardly apart from said second side opening to open said case body.

9. A jewelry box, as recited in claim 8, wherein each of said hinge means and said second hinge means comprises a first piece and a second piece pivotally connected with said first piece, said two first pieces of said two hinge means being respectively affixed to said bottom edge portion of said first cover lip and a bottom edge portion of said second cover lip, said two second pieces of said two hinge means being respectively affixed to said side edge portion and said another opposite side edge portion of said bottom wall of said case body, so that said two cover lips are hingedly and pivotally connected with said case body, wherein each of said hinge means provides a slot transversely thereon to fittedly receive a tip portion of said bottom edge portion of each of said two cover lips when each of said two cover lips is pulled and turned sidewardly apart from said case body to said open position, so as to enable each or said two cover lips being opened wide until both outer surfaces of said two cover lip and said case body are in contact with a supporting surface to ensure a balance and stable standing of said jewelry box, wherein weights of said case body and said two cover lip are evenly and stably supported by said supporting surface.

10. A jewelry box, as recited in claim 9, wherein said two first pieces of said two hinge means are respectively inserted and glued into two receiving grooves formed at said two bottom edge portions of said two second cover lips respectively for affixing said two first pieces firmly in position with said two cover lips, and that said two second pieces of said two hinge means are respectively inserted and glued into two receiving gaps formed at said two side edge portions of said bottom wall of said case body respectively for affixing said two second pieces firmly in position with said bottom wall of said case body.

11. A jewelry box, as recited in claim 9, wherein said two positioning means each comprises two symmetrical semicircular first wings and two symmetrical semicircular second wings, said two first wings being respectively extended from two side edges of said first piece upwardly and perpendicularly in semi-circular manner toward a top surface of said second piece, said two second wings being respectively extended from two side edges of said second piece upwardly and perpendicularly in semi-circular manner toward a top surface of said first piece, so that said two first wings and said two parallel second wings are capable of proximately overlapping when said first and second pieces are aligned in a linearly horizontal position.

12. A jewelry box, as recited in claim 11, wherein each of said two first wings has an inner surface forming a circular protrusion near a far end thereof, each of said two second wings having an outer surface forming a first and a second circular indention near two ends thereof, so that when said first and second pieces are aligned in said linearly horizontal position, said two protrusions of said two first wings are appropriately engaged with said two first indentions of said two second wings respectively, and that said first piece and said second piece of said hinge means are thus locked in said linearly aligning position so as to ensure said close position of said respective cover lip to fittedly cover said corresponding side opening of said case body, moreover when a pulling force is applied to one of said cover lips to overcome an engagement between said two protrusions on said two first wings and said first two indentions on said two second wings, said respective cover lip is pulled and turned sidewardly apart from said case body to said open position for uncovering said corresponding side opening until said two protrusions on said two first wings connected to said respective cover lip are appropriately engaged with said two second indentions of said two second wings connected with said case body, so that said first and second pieces of each of said hinge means arc locked in a relatively V-shaped condition to maintain said open position of said respective cover lip.

13. A jewelry box, as recited in claim 10, wherein said two positioning means each comprises two symmetrical semicircular first wings and two symmetrical semi-circular second wings, said two first wings being respectively extended from two side edges of said first piece upwardly and perpendicularly in semi-circular manner toward a top surface of said second piece, said two second wings being respectively extended from two side edges of said second piece upwardly and perpendicularly in semi-circular manner toward a top surface of said first piece, so that said two first wings and said two parallel second wings are capable of proximately overlapping when said first and second pieces are aligned in a linearly horizontal position.

14. A jewelry box, as recited in claim 13, wherein each of said two first wings has an inner surface forming a circular protrusion near a far end thereof, each of said two second wings having an outer surface forming a first and a second circular indention near two ends thereof, so that when said first and second pieces are aligned in said linearly horizontal position, said two protrusions of said two first wings are appropriately engaged with said two first indentions of said two second wings respectively, and that said first piece and said second piece of said hinge means are thus locked in said linearly aligning position so as to ensure said close position of said respective cover lip to fittedly cover said corresponding side opening of said case body, moreover when a pulling force is applied to one of said cover lips to overcome an engagement between said two protrusions on said two first wings and said first two indentions on said two second wings, said respective cover lip is pulled and turned sidewardly apart from said case body to said open position for uncovering said corresponding side opening until said two protrusions on said two first wings connected to said respective cover lip are appropriately engaged with said two second indentions of said two second wings connected with said case body, so that said first and second pieces of each of said hinge means are locked in a relatively V-shaped condition to maintain said open position of said respective cover lip.

15. A jewelry box as recited in claim 8, wherein said jewelry box is a cartoon heart shape box, said two side openings of said case body comprising by a front wall, a back wall, a top wall, and a V-shape bottom wall, said front wall and said back wall having an identical cartoon heart shape, said top wall being transversally connected between a central top portion of said front wall and a central top portion of said back wall, said bottom wall being perpendicularly and integrally extended from a central bottom edge portion of said front wall to a central bottom edge of said back wall so as to support said front wall and said back wall parallelly and define said interior cavity between said front and back walls, said front wall and said back wall each having two symmetrical convex side edges between said top wall and said bottom wall so as to define said two side openings.

16. A jewelry box, as recited in claim 15, wherein said two cover lids are identical in shape and structure that each comprises a C-shaped side wall which two parallel edges integrally connecting with a front panel and a back panel respectively to form a lip body having a receiving chamber defined therein.

17. A jewelry box, as recited in claim 14, wherein said jewelry box is a cartoon heart shape box, said two side openings of said case body comprising by a front wall, a back wall, a top wall, and a V-shape bottom wall, said front wall and said back wall having an identical cartoon heart shape, said top wall being transversally connected between a central top portion of said front wall and a central top portion of said back wall, said bottom wall being perpendicularly and integrally extended from a central bottom edge portion of said front wall to a central bottom edge of said back wall so as to support said front wall and said back wall parallelly and define said interior cavity between said front and back walls, said front wall and said back wall each having two symmetrical convex side edges between said top wall and said bottom wall so as to define said two side openings.

18. A jewelry box, as recited in claim 17, wherein said two cover lids are identical in shape and structure that each comprises a C-shaped side wall which two parallel edges integrally connecting with a front panel and a back panel respectively to form a lip body having a receiving chamber defined therein.

* * * * *